US008151612B2

(12) United States Patent
Iwamoto

(10) Patent No.: US 8,151,612 B2
(45) Date of Patent: Apr. 10, 2012

(54) ELONGATION ROLLING CONTROL METHOD

(75) Inventor: Hiroyuki Iwamoto, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/075,315

(22) Filed: Mar. 30, 2011

(65) Prior Publication Data

US 2011/0174033 A1 Jul. 21, 2011

Related U.S. Application Data

(60) Division of application No. 11/905,352, filed on Sep. 28, 2007, now Pat. No. 7,937,978, and a continuation of application No. PCT/JP2006/306874, filed on Mar. 31, 2006.

(30) Foreign Application Priority Data

Mar. 31, 2005 (JP) ..... 2005-103497

(51) Int. Cl.
*B21B 37/00* (2006.01)
*B21B 37/56* (2006.01)
*B21B 17/08* (2006.01)

(52) U.S. Cl. ..... 72/9.2; 72/11.6; 72/16.8; 72/208

(58) Field of Classification Search ..... 72/8.3, 72/8.4, 8.9, 9.2, 9.4, 11.1, 11.2, 11.6, 11.8, 72/12.7, 15.3, 15.5, 16.8, 16.9, 16.2, 18.8, 72/18.6, 19.6, 208
See application file for complete search history.

(56) References Cited

U.S. PATENT DOCUMENTS 7,028,518 B2 * 4/2006 Sasaki et al. ..... 72/9.2
7,093,469 B2 * 8/2006 Yamane ..... 72/9.2
2006/0059969 A1 * 3/2006 Iwamoto et al. ..... 72/235

FOREIGN PATENT DOCUMENTS

| | | |
|---|---|---|
| JP | 61-093904 | 5/1986 |
| JP | 61-135409 | 6/1986 |
| JP | 08-071616 | 3/1996 |
| WO | 98/55243 | 12/1998 |

OTHER PUBLICATIONS

R. Keck et al., "Wanddickenmessung an 1230° C heissen Rohrluppen mit einem neuartigen Laser-Ultrschall-System" Stahl Und Eisen, Verlag Stahleisen, Dusseldorf, Germany, vol. 107, No. 22, Nov. 1, 1987, pp. 63-66, 103, XP002081910, ISSN: 0340-4803.

* cited by examiner

*Primary Examiner* — Debra Sullivan
(74) *Attorney, Agent, or Firm* — Clark & Brody

(57) ABSTRACT

An elongation rolling control method is provided which can manufacture a hollow shell of high dimensional accuracy and can suppress rolling problems. It is an elongation rolling control method in which the groove bottom wall thickness of a hollow shell P in stand #1 having an ultrasonic wall thickness wall gauge 1 installed between it and stand #2 is measured, the outer diameter of a mandrel bar B is calculated based on the set value of the roll gap in stand #1 and the groove bottom wall thickness of the hollow shell P, the location in the lengthwise direction of the mandrel bar B for which the outer diameter was calculated is determined based on positional information on a bar retainer BR, the distribution in the lengthwise direction of the outer diameter of the mandrel bar is calculated by repeating the above steps, the location in the lengthwise direction of the mandrel bar which contacts the hollow shell in a subsequent stand is determined based on positional information on the bar retainer, and the roll gap in the subsequent stand is set based is on the outer diameter of the determined location in the lengthwise direction of the mandrel bar.

2 Claims, 2 Drawing Sheets

ELONGATION ROLLING CONTROL METHOD

TECHNICAL FIELD

This invention relates to an elongation rolling control method. Specifically, the present invention relates to an elongation rolling control method which can manufacture a seamless tube having high dimensional accuracy and which can suppress the occurrence of rolling problems by measuring the wall thickness of a hollow shell into which a mandrel bar is inserted and controlling elongation rolling of the hollow shell in a mandrel mill based on the measured results.

BACKGROUND ART

Up to the present time, there have been many proposals of inventions which measure the wall thickness of an object of interest using a gamma ray wall thickness gauge and set and correct the rolling conditions based on the measured results (see Patent Document 1, for example).

A gamma ray wall thickness gauge measures wall thickness based on the amount of attenuation of gamma rays passing through an object of interest. On account of this principle of measurement, it is not possible to measure the wall thickness of a hollow shell into which a mandrel bar has been inserted using a gamma ray wall thickness gauge. Therefore, it is of course not possible to measure the wall thickness between the stands of a mandrel mill with a gamma ray wall thickness gauge. Even on the exit side of a mandrel mill, thickness measurement can only be performed with a retractable mandrel mill in which the inserted mandrel bar is retracted towards the entrance side after the completion of elongation rolling. Moreover, even with a retractable mandrel mill, the wall thickness can be measured only in a location spaced by a certain amount from the immediate vicinity of the exit of the mill. Due to these limitations, there is naturally a limit to the extent to which the results of wall thickness measurement by a gamma ray thickness gauge can be utilized to carry out high accuracy control.

Thus, in a control method for a mandrel mill using a conventional gamma ray wall thickness gauge, there is the fundamental problem that it is not possible to measure the wall thickness of a hollow shell into which a mandrel bar is inserted. Due to this problem, the following four specific problems exist.

(Problem 1)

In a conventional control method using a gamma ray wall thickness gauge, in initial elongation rolling, it is not possible to set a roll gap corresponding to the outer diameter of the mandrel bar, and thus a high accuracy cannot be obtained for the wall thickness of hollow shells which initially undergo elongation rolling.

A method which is conceivable in order to obtain a hollow shell with a highly accurate wall thickness by elongation rolling using a mandrel mill is one in which the outer diameter of a mandrel bar is estimated by calculation and the roll gap of a predetermined stand is set in accordance with the estimated outer diameter of the mandrel bar. In the past, in order to carry out this method, the wall thickness of a hollow shell on the exit side of a mandrel mill (a retractable mandrel mill) was measured using a gamma ray wall thickness gauge, and based on the results of this measurement and the set value of the roll gap in the final stand, the outer diameter of the mandrel bar was estimated. However, this estimating method estimates the outer diameter of a mandrel bar based on the measured value of the wall thickness on the exit side of a mandrel mill. Therefore, elongation rolling of a hollow shell for which the wall thickness was measured is already completed by the time that the outer diameter of the mandrel bar is estimated. A mandrel mill normally uses a plurality of mandrel bars while circulating them, and a highly accurate wall thickness cannot be obtained for the first hollow shell to be rolled using each mandrel bar, i.e., for the same number of hollow shells as the number of mandrel bars being circulated.

(Problem 2)

As the measurement of wall thickness of a hollow shell by a gamma ray wall thickness gauge cannot be performed between stands of a mandrel mill, its wall thickness facing the flange portions wall thickness must be predicted, thereby making it impossible to obtain a highly accurate wall thickness.

The locations of a hollow shell corresponding to its flange portion wall thickness at one stand becomes locations corresponding to its groove bottom wall thickness at the next stand where the wall thickness is reduced by grooved rolls. Accordingly, if an error develops in the prediction of the flange portion wall thickness of a hollow shell, an error develops in the amount of redaction. In addition, the speed of the hollow shell on the entrance and exit sides of the stand varies, and the tensile force between stands varies. As a result, the deformation of the hollow shell in the locations corresponding to the flange portion wall thickness which occurs at the next stand greatly deviates from the prediction, and defective rolling with worsened dimensional accuracy occurs with a hollow shell made of a difficult-to-work material.

(Problem 3)

In elongation rolling using a mandrel mill, opposing thickness deviations, which are a phenomenon in which thick-walled portions and thin-walled portions alternatingly develop at a pitch of approximately 90° in the circumferential direction of a hollow shell, sometimes develop. In order to suppress the occurrence of opposing thickness deviations, the rolling positions of the grooved rolls can be adjusted so that the thick-walled portions become thinner and the thin-walled portions become thicker. However, as stated above, with a gamma ray wall thickness gauge, it is not possible to carry out wall thickness measurement except on the exit side of a mandrel mill (a retractable mandrel mill) and in a location separated from the mill by a certain extent. Therefore, even if opposing thickness deviations develop in a hollow shell which underwent wall thickness measurement, it is no longer possible to adjust the rolling positions of the grooved rolls for that hollow shell. In addition, in a mandrel mill of a type other than a retractable mandrel mill, it is not possible at all to perform measurement of opposing thickness deviations.

(Problem 4)

In elongation rolling using a mandrel mill, it is important to ascertain the distance between the groove bottoms of grooved roll in a stand. Since this distance cannot be directly measured, the rolling position is corrected by zero adjustment of rolling position achieved by contacting the flange portions of the grooved roll with each other in view of the result of measurement by a gamma ray wall thickness gauge installed on the exit side of the mandrel mill. However, only the rolling position of the grooved rolls installed in the final stand can be corrected by this method. Accordingly, in a control method for a mandrel mill using a conventional gamma ray wall thickness gauge, it is not possible to increase the accuracy of zero adjustment of the rolling position of the grooved rolls in previous stands.

Patent Document 1: IP H08-71616 A1

DISCLOSURE OF INVENTION

The present invention was made in order to solve the above-described problems of the prior art, and its object is to provide an elongation rolling control method for a mandrel mill which can solve the problems present in an elongation rolling control method for a mandrel mill using a conventional gamma ray wall thickness gauge that the wall thickness of a hollow shell into which a mandrel bar is inserted cannot be measured.

As a result of diligent investigations with the object of solving this problem, the present inventors found that the wall thickness of a hollow shell having a mandrel bar inserted into its interior can be measured if an ultrasonic wall thickness gauge which measures the wall thickness based on the difference in the reflected time of ultrasonic waves from the inner and outer surfaces of a hollow shell is used instead of a gamma ray wall thickness gauge. The reason for this is thought to be that even when a mandrel bar is inserted into a hollow shell, a layer of air is present between the outer surface of the mandrel bar and the inner surface of the hollow shell, and ultrasonic waves are reflected from the inner surface of the hollow shell by this layer of air. Accordingly, it was found if an ultrasonic wall thickness gauge is used, it becomes possible to perform measurement of the wall thickness of a hollow shell between the stands of a mandrel mill or in the immediate vicinity of the exit side which could not be measured in the past, thereby making it possible to solve the various problems present with a conventional mandrel mill control method using a gamma ray thickness gauge. They thereby completed the present invention.

The present invention is an elongation rolling control method characterized in that the wall thickness of a hollow shell into which a mandrel bar is inserted is measured between the rolling stands of a mandrel mill or on the exit side of the final stand of the mandrel mill using an ultrasonic wall thickness gauge, and the mandrel mill is controlled based on the measured value.

The present invention is also an elongation rolling control method characterized by comprising a first step of measuring the groove bottom wall thickness of a hollow shell in a stand immediately before the installation position of an ultrasonic wall thickness gauge installed between predetermined stands of a mandrel mill, a second step of calculating the outer diameter of a mandrel bar based on the set value of the roll gap in the immediately preceding stand and the groove bottom wall thickness of the hollow shell measured in the first step, a third step of determining the location in the lengthwise direction of the mandrel bar for which the outer diameter was calculated in the second step based on positional information on a bar retainer, a fourth step of calculating the distribution in the lengthwise direction of the outer diameter of the mandrel bar by repeating the first step through the third step, a fifth step of determining a location in the lengthwise direction of the mandrel bar which contacts the hollow shell in a subsequent stand after the immediately preceding stand based on the positional information on the bar retainer, a sixth step of calculating the outer diameter at the location in the lengthwise direction of the mandrel bar which was determined in the fifth step based on the distribution in the lengthwise direction of the outer diameter of the mandrel bar calculated in the fourth step, and a seventh step of setting the roll gap in the subsequent stand based on the outer diameter at the position in the lengthwise direction of the mandrel bar calculated in the sixth step. Problem 1 can be solved by this invention.

The expression "groove bottom wall thickness of a hollow shell" used herein means the wall thickness of the portions of a hollow shell opposing the groove bottom portions of grooved rolls.

The present invention is also an elongation rolling control method characterized by comprising a first step of measuring the flange portion wall thickness of a hollow shell in a stand immediately before the installation position of an ultrasonic wall thickness gauge installed between predetermined stands of a mandrel mill, and a second step of setting the roll gap in the stand immediately after the installation position of the ultrasonic wall thickness gauge based on the flange portion wall thickness of the hollow shell measured in the first step. Problem 2 can be solved by this invention.

The expression "flange portion wall thickness of a hollow shell" used herein means the wall thickness of the portions of a hollow shell facing the flange portions of grooved rolls.

The present invention is also an elongation rolling control method characterized by comprising a first step of measuring the distribution of the wall thickness in the circumferential direction of a hollow shell from when the front end of the hollow shell passes the installation position of an ultrasonic wall thickness gauge installed on the exit side of a mandrel mill, a second step of calculating the to components and direction of opposing thickness deviations based on the wall thickness distribution in the circumferential direction of the hollow shell measured in the first step, and a third step of correcting the rolling position of the grooved rolls of a predetermined stand at the time of elongation rolling of the hollow shell or at the time of elongation rolling of the hollow shell which undergoes elongation rolling is after this hollow shell based on the components and direction of the opposing wall thickness deviations calculated in the second step. Problem 3 can be solved by this invention.

The expression "components of the opposing thickness deviations" used herein means, among the thickness deviations which develop in a hollow shell, the thickness deviation components which alternatingly develop as thick-walled portions and thin-walled portions at a pitch of approximately 90° in the circumferential direction of the hollow shell.

The present invention is also an elongation rolling control method characterized by comprising a first step of measuring the groove bottom wall thickness of a hollow shell in a stand immediately before the installation position of an ultrasonic wall thickness gauge installed between predetermined stands of a mandrel mill, a second step of calculating the error in the set value of the rolling position of the grooved rolls of the immediately preceding stand based on the set value of the roll gap in the immediately preceding stand and the groove bottom wall thickness of the hollow shell measured in the first step, and a third step of correcting the rolling position of the grooved rolls of the immediately preceding stand based on a rolling position measurement error obtained by smoothing the error in the set value of the rolling position calculated in the second step.

The expression "smoothing the error in the set value of the rolling position" used herein means that smoothing processing such as exponential smoothing or moving average method is performed on each hollow shell based on the error in the set value of the rolling position calculated for a plurality of hollow shells.

In the present invention, it is preferable that a laser-ultrasonic wall thickness gauge which can measure the wall thickness of a hollow shell without contacting the hollow shell be used as an ultrasonic wall thickness gauge.

In an elongation rolling control method according to the present invention, by measuring the wall thickness of a hollow shell in a state in which a mandrel bar is inserted into its interior and controlling a mandrel mill based on the measured result, a seamless tube of high dimensional accuracy can be manufactured, and rolling problems can be suppressed.

List Of Reference Symbols

1 ultrasonic wall thickness gauge
2 controller
3 rolling mechanism
B mandrel bar
P hollow shell
R grooved roll
BR bar retainer

Best Mode For Carrying Out The Invention

Below, the best mode for carrying out an elongation rolling control method according to the present invention will be explained in detail while referring to the attached drawings.

(Embodiment 1)

Figure 1:
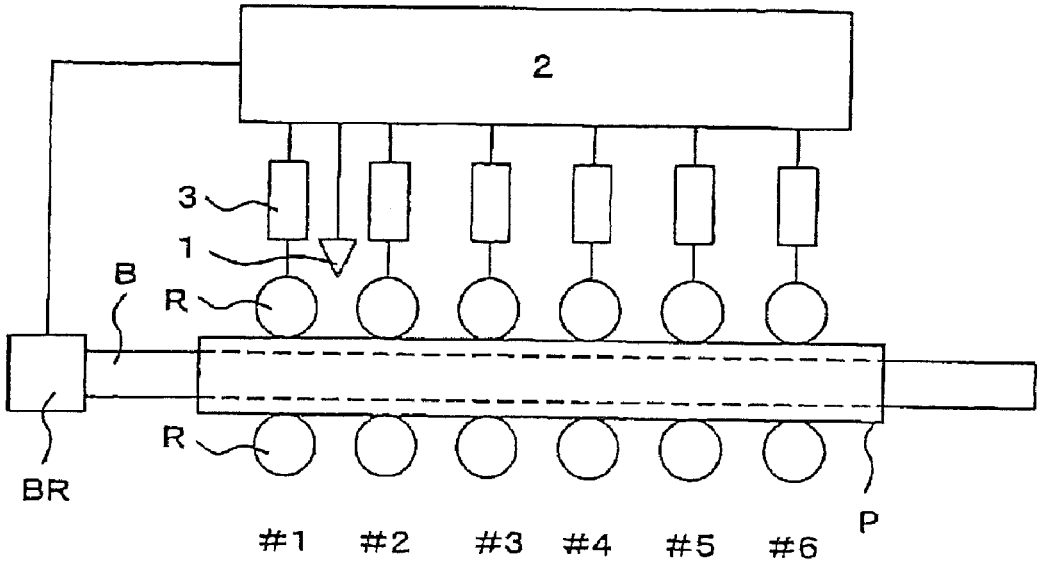
FIG. 1 is an explanatory view schematically showing the general structure of a mandrel mill to which a control method according to a first embodiment is applied.

FIG. 1 is an explanatory view schematically showing the general structure of an apparatus for a mandrel mill (a retained mandrel mill using a bar retainer BR) which applies a control method according to embodiment 1.

As shown in FIG. 1, a control method according to this embodiment uses an ultrasonic wall thickness gauge 1 installed between predetermined stands of a mandrel mill (between stand #1 and stand #2 in the example shown in FIG. 1).

The ultrasonic wall thickness gauge used in this embodiment is a laser-ultrasonic wall thickness gauge. The laser-ultrasonic wall thickness gauge 1 has a is pulsed laser for transmitting ultrasonic waves from the surface into the interior of a hollow shell P, and a continuous wave laser and an interferometer for receiving ultrasonic waves which are reflected from the inner surface of the hollow shell P. High-intensity pulsed laser beam is emitted from the pulsed laser. The emitted pulsed laser beam impacts the surface of the hollow shell P and produces thermal contraction of the hollow shell P, which generates ultrasonic waves. The generated ultrasonic waves are propagated inside the hollow shell P and reflected from the inner surface of the hollow shell P, and they again return to the surface of the hollow shell P. The continuous wave laser and the interferometer are arranged so that the laser beam emitted from the continuous wave laser always irradiates the surface of the hollow shell P and that the reflected light from the surface of the hollow shell P is incident on the interferometer. When ultrasonic waves return to the surface of the hollow shell P, its surface displaces. As a result, the phase of the reflected light which is incident on the interferometer changes, and the state of interference changes. The wall thickness of the hollow shell P is measured by measuring the time from when the pulsed laser beam was emitted from the pulsed laser until the change in the interference state is detected.

The ultrasonic wall thickness gauge 1 is disposed so as to be able to measure the groove bottom wall thickness of the hollow shell P at a stand immediately before the installation position of the ultrasonic wall thickness gauge 1 (stand #1 in the example shown in FIG. 1). Namely, it is disposed so as to measure the wall thickness of a portion of the hollow shell P opposing a groove bottom of the grooved rolls R provided in stand #1. The directions of emission by the two lasers are set so that the laser beam emitted from the pulsed laser and the laser beam emitted from the continuous wave laser both irradiate a portion of the hollow shell P opposing a groove bottom of the grooved rolls R provided in stand #1.

The groove bottom wall thickness of the hollow shell P which is measured by the ultrasonic wall thickness gauge 1 is input into a controller 2. The controller 2 performs calculation to estimate the outer diameter of the mandrel bar B based on the set value of the roll gap of stand #1 which is the immediately preceding stand and the measured groove bottom wall thickness of the hollow shell P.

Positional information on a bar retainer BR which holds the rear end of the mandrel bar B is also input to the controller 2. Based on the positional information on the bar retainer BR which was input to it, the controller 2 determines the portion in the lengthwise direction of the mandrel bar B where the outer diameter was calculated (the portion in the lengthwise direction of the mandrel bar B used in stand #1). Namely, the distance between the rear end of the mandrel bar B and stand #1 which is the immediately preceding stand, i.e., the locations in the lengthwise direction of the mandrel bar using the rear end of the mandrel bar B as a reference is determined from the positional information on the bar retainer BR.

By repeating the above operation, the controller 2 calculates and stores the distribution of the outer diameter of the mandrel bar B in the lengthwise direction.

Next, based on the positional information on the bar retainer BR, the controller 2 determines the location in the lengthwise direction of the mandrel bar B which contacts the hollow shell P in a stand or stands subsequent to stand #1, which is the immediately preceding stand. Then, based on the distribution in the lengthwise direction of the outer diameter of the mandrel bar B which was calculated and stored as described above, the controller 2 calculates the outer diameter of each of the locations in the lengthwise direction of the mandrel bar B which contact the hollow shell P in subsequent stands (stand #2-stand #6) which are subsequent to stand #1, which is the immediately preceding stand. Based on the calculated outer diameter of the mandrel bar B, the controller 2 performs calculations to set suitable roll gaps in the subsequent stands (stand #2-stand #6), and it controls the rolling mechanisms 3 for the subsequent stands (stand #2-stand #6) so as to obtain these roll gaps. The rolling mechanisms 3 are constituted by cylinders or the like, and they adjust the rolling positions of the grooved rolls R in accordance with the set roll gaps.

As explained above, a rolling control method for a mandrel mill according to this embodiment has an ultrasonic wall thickness gauge 1 installed between stands, it calculates the outer diameter of a mandrel bar B based on the measured value of the thickness (the groove bottom wall thickness), and it sets the roll gaps of the subsequent stands (stand #2-stand #6) downstream of the installation position of the ultrasonic wall thickness gauge 1 accordingly.

Therefore, in contrast to a conventional control method using a gamma ray wall thickness gauge, even if this mandrel bar B is the first provided to elongation rolling, (in other words, even if the hollow shell P is the first hollow shell to be employed with this mandrel bar B), the outer diameter of the mandrel bar B can be calculated with high accuracy when rolling the hollow shell P, and as a result, elongation rolling by the mandrel mill can be carried out with a highly accurate wall thickness starting with the first hollow shell P.

(Embodiment 2)

Figure 2:
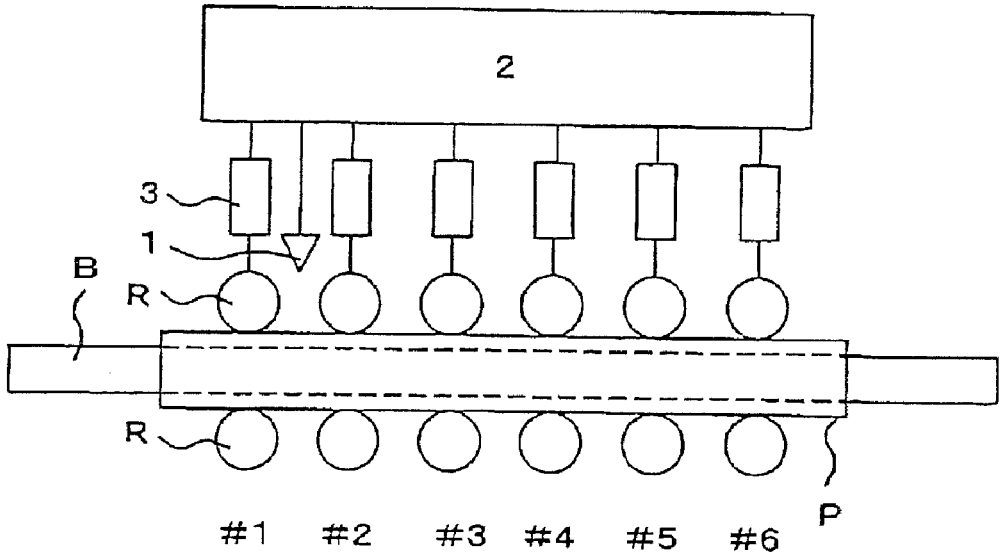
FIG. 2 is an explanatory view schematically showing the genearal structure of an apparatus for a mandrel mill to which a control method according to a second and fourth embodiment is applied.

FIG. 2 is an explanatory view schematically showing the general structure of an apparatus for a mandrel mill applying a control method according to embodiment 2.

As shown in FIG. 2, in the same manner as in above-described embodiment 1, a control method according to this embodiment uses an ultrasonic wall thickness gauge 1 installed between predetermined stands of a mandrel mill (between stand #1 and stand #2 in the example shown in FIG. 2).

A control method according to this embodiment differs from embodiment 1 in that it is not limited to application to a retained mandrel mill using a bar retainer. In addition, it differs from embodiment 1 in that an ultrasonic wall thickness gauge 1 according to this embodiment is disposed so as to measure the flange portion wall thickness of the hollow shell P in the stand immediately before the installation position of the ultrasonic wall thickness gauge 1 (stand #1 in the example shown in FIG. 2).

Namely, the ultrasonic wall thickness gauge 1 used in this embodiment is disposed so as to measure a portion of the hollow shell P opposing the flange portion of the grooved rolls R disposed in stand #1. The ultrasonic wall thickness gauge 1 used in this embodiment is also a laser-ultrasonic wall thickness gauge. The direction of each laser is set so that the light emitted from a pulsed laser and the light emitted from a continuous wave laser are both irradiated on a portion of the hollow shell P opposing the flanges of the grooved rolls R provided in stand #1.

The flange portion wall thickness of the hollow shell P measured by the ultrasonic wall thickness gauge 1 is input to a controller 2. Based on the measured flange portion wall thickness of the hollow shell P, the controller 2 calculates and sets a suitable roll gap for the stand (stand #2 in this embodiment) immediately after the installation position of the ultrasonic wall thickness gauge 1, and it controls the rolling mechanism 3 for stand #2 so as to obtain this roll gap. The rolling mechanism 3 adjusts the rolling position of the grooved rolls R in accordance with the set roll gap. The flange portion wall thickness, i.e., the groove bottom wall thickness on the entrance side of stand #2 easily varies, and the rolling load of stand #2 varies in accordance with the variation in the groove bottom wall thickness on the entrance side, and its mill spring (rolling load/mill stiffness coefficient) varies. Accordingly, the rolling mechanism 3 preferably previously adjusts the rolling position of the grooved rolls R in accordance with the set roll gap before the hollow shell P reaches stand #2, whereby it can make the wall thickness of the hollow shell P after rolling in stand #2 constant. If the amount of reduction of the wall thickness in stand #2 varies, the rolling speeds on the entrance and exit sides of stand #2 vary, and the tension between stands changes. However, by measuring the wall thickness on the entrance side of stand #2 by the ultrasonic wall thickness gauge 1 according to this embodiment, variations in the amount of wall thickness reduction can be predicted, and variations in tension can be suppressed by changing the rotational speed of the grooved rolls R so as to suppress variation in tension between stands.

As explained above, with an elongation rolling control method according to this embodiment, the flange portion wall thickness (which corresponds to the groove bottom wall thickness from the standpoint of the stand immediately after the installation position of the ultrasonic wall thickness gauge 1) is actually measured by the ultrasonic wall thickness gauge 1, and based on this flange portion wall thickness, a suitable roll gap is set in the stand (stand #2 in this embodiment) immediately after the installation position of the ultrasonic wall thickness gauge 1. Accordingly, in contrast to a conventional rolling control method using a gamma ray wall thickness gauge in which it was necessary to predict the flange portion wall thickness and in which there was the possibility of defective rolling and a worsening is of dimensional accuracy due to errors in the prediction, these problems can be eliminated with certainty. In addition, by predicting the variation in the amount of reduction of the wall thickness in the stand immediately after the installation position of the ultrasonic wall thickness gauge 1, variations in the tensile force between stands can be suppressed.

(Embodiment 3)

Figure 3:
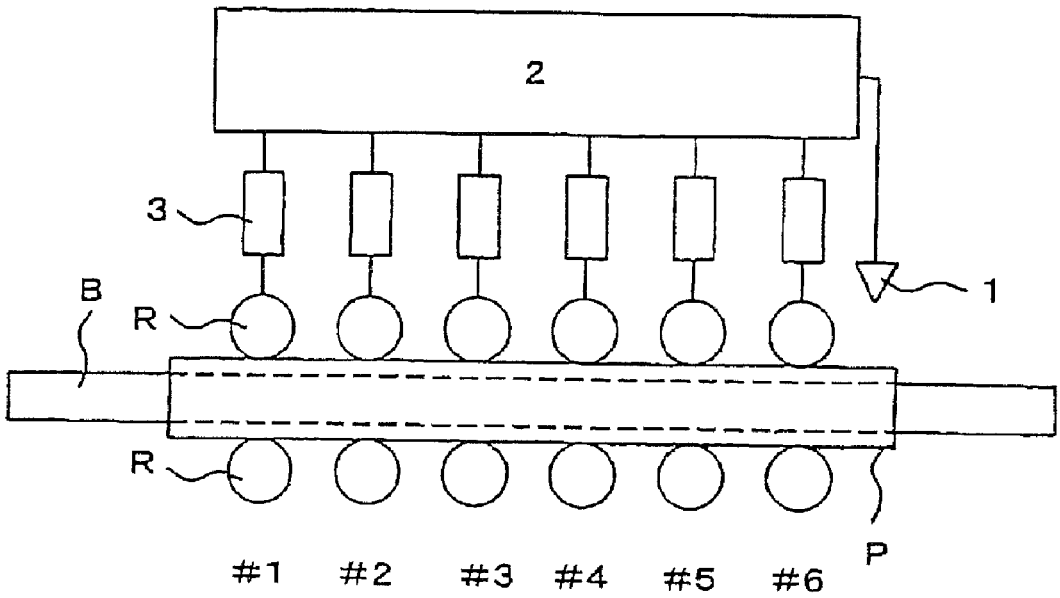
FIG. 3 is an explanatory view schematically showing the general structure of an apparatus for a mandrel mill to which a control method according to a third embodiment is applied.

FIG. 3 is an explanatory view schematically showing the general structure of an apparatus for a mandrel mill applying a control method according to a third embodiment.

As shown in FIG. 3, in contrast to above-described embodiment 1 and embodiment 2, a control method according to this embodiment installs an ultrasonic wall thickness gauge 1 in the immediate vicinity of the exit side of a mandrel mill. It also differs from embodiment 1 and embodiment 2 in that a plurality of ultrasonic wall thickness gauges 1 are provided in the circumferential direction of the hollow shell P, or the ultrasonic wall thickness gauge 1 can perform scanning in the circumferential direction of the hollow shell P in order to measure the wall thickness distribution in the circumferential direction of the hollow shell P. The structure of the apparatus is otherwise the same as for above-described embodiment 2, so an explanation thereof will be omitted.

The ultrasonic wall thickness gauge 1 according to this embodiment measures the wall thickness distribution in the circumferential direction of the hollow shell P from when the front end of the hollow shell P passes the installation position of the ultrasonic wall thickness gauge 1. The wall thickness distribution in the circumferential direction of the hollow shell measured by the ultrasonic wall thickness gauge 1 is input to a controller 2.

The controller 2 calculates the components and direction of the opposing to thickness deviations by performing Fourier analysis of the measured wall thickness distribution in the circumferential direction of the hollow shell P. Based on the calculated components and direction of the opposing thickness deviations, the controller 2 corrects the setting for the rolling position of the grooved rolls R of a predetermined stand at the time of rolling of this hollow shell P or at the time of rolling of the next hollow shell P. Namely, it corrects the rolling position of the grooved rolls R of a predetermined stand for which the direction of the thick-walled portions is the rolling direction so that the thick-walled portions of the components of the opposing thickness deviations become thinner, and it corrects the rolling position of the grooved rolls R of a predetermined stand for which the direction of the thin-walled portions is the rolling direction so that the thin-walled portions of the components of the opposing thickness deviations become thicker.

The controller 2 controls the rolling mechanism 3 of the predetermined stand so as to obtain this rolling position after correction. The rolling mechanism 3 adjusts the rolling position of the grooved rolls R in accordance with the rolling position after correction.

As explained above, in an elongation rolling control method according to this embodiment, an ultrasonic wall thickness gauge 1 is installed in the immediate vicinity of the exit side of a mandrel mill, the wall thickness distribution in the circumferential is measured from the front end of a hollow shell P, and the setting for the rolling position of the grooved rolls R in a predetermined stand is corrected at the time of rolling this hollow shell P or at the time of rolling the next hollow shell P.

Accordingly, when correcting the setting for the rolling position at the time of rolling the hollow shell P for which the wall thickness distribution in the circumferential direction was measured, in contrast to a conventional control method using a gamma ray wall thickness gauge, the rolling position of grooved rolls can be corrected even for the first hollow shell P in which opposing wall thickness deviations develop, and the accuracy of the wall thickness can be increased from the first hollow shell P.

In addition, the accuracy of the wall thickness of a hollow shell P can be increased for a mandrel mill other than for a retractable mandrel mill by measuring the opposing wall thickness deviations and correcting the setting of the rolling position of the grooved rolls R.

(Embodiment 4)

The structure of an apparatus for a mandrel mill applying an elongation is rolling control method according to this embodiment is the same as for the mandrel mill explained with respect to FIG. 2, so this embodiment will be explained while referring to FIG. 2.

In an elongation rolling control method according to this embodiment, in the same manner as in embodiment 2, an ultrasonic wall thickness gauge 1 is installed between predetermined stands of a mandrel mill (between stand #1 and stand #2 in the example shown in FIG. 2). However, it differs from embodiment 2 in that the ultrasonic wall thickness gauge 1 according to this embodiment is disposed so as to measure the groove bottom wall thickness of a hollow shell P in the stand immediately before the installation position of the ultrasonic wall thickness gauge 1 (stand #1 in the example shown in FIG. 2) in the same manner as in embodiment 1.

The groove bottom wall thickness of the hollow shell P measured by the ultrasonic wall thickness gauge 1 is input to a controller 2. Based on the set value of the roll gap of the immediately preceding stand (stand #1) and the measured groove bottom wall thickness of the hollow shell P, the controller 2 calculates the error in the set value of the rolling position of the grooved rolls of the immediately preceding stand (stand #1).

When calculating the error in the set value of the rolling position, the controller 2 uses the set value of the outer diameter of the mandrel bar B. Therefore, if there is an error between the set value of the outer diameter of the mandrel bar B and the actual outer diameter, the error in the outer diameter of the mandrel bar B is included in the calculated error in the set value of the rolling position. In order to accurately determine the true error in the set value of the rolling position (the error in the set value of the rolling position not including an error in the outer diameter of the mandrel bar B), the error in the set value of the rolling position calculated for a plurality of hollow shells P is utilized, and the influence of the error in the outer diameter of the mandrel bar B, which can be a random value, can be effectively removed by performing smoothing processing such as exponential smoothing processing or moving average method on each hollow shell P.

Accordingly, the controller 2 performs suitable smoothing processing on the errors in the set value of the calculated rolling position, and as a result, the error in the outer diameter of the mandrel bar B, which can be included in the error in the set value of the rolling position, is excluded. Based on the error in the measurement of the rolling position after smoothing processing, the rolling position of the grooved rolls R of the immediately preceding stand (stand #1) is corrected. The controller 2 controls the rolling mechanism 3 of the immediately preceding stand (stand #1) so as to obtain the corrected rolling position. The rolling mechanism 3 controls the rolling position of the grooved rolls R in accordance with the corrected rolling position.

As described above, in an elongation rolling control method according to this embodiment, the groove bottom wall thickness of a hollow shell P in the stand immediately before the installation position of an ultrasonic wall thickness gauge 1 installed between stands of a mandrel mill is measured, and the rolling position of the grooved rolls R in this stand is corrected. Accordingly, in contrast to a conventional rolling control method using a gamma ray wall thickness gauge, an increase in the accuracy of zero adjustment of the rolling position in an arbitrary stand corresponding to the installation position of an ultrasonic wall thickness gauge 1 can be achieved.

It is particularly effective to apply an elongation rolling control method according to this embodiment to a three-roll mandrel mill with which it is difficult to perform zero adjustment of the rolling position by contacting the flange portions of the grooved rolls against each other.

The invention claimed is:

1. An elongation rolling control method characterized by comprising:

a first step of measuring a groove bottom wall thickness of a hollow shell in a stand immediately before an installation position of an ultrasonic wall thickness gauge installed between predetermined stands of a mandrel mill, a second step of calculating an outer diameter of a mandrel bar based on a set value of a roll gap in the immediately preceding stand and the groove bottom wall thickness of the hollow shell measured in the first step, a third step of determining a location in a lengthwise direction of the mandrel bar for which the outer diameter was calculated in the second step based on positional information on a bar retainer, a fourth step of calculating a distribution in the lengthwise direction of the outer diameter of the mandrel bar by repeating the first step through the third step, a fifth step of determining a location in the lengthwise direction of the mandrel bar which contacts the hollow shell in a stand subsequent to the immediately preceding stand based on positional information on the bar retainer, a sixth step of calculating the outer diameter of the location in the lengthwise direction of the mandrel bar determined in the fifth step based on the distribution in the lengthwise direction of the outer diameter of the mandrel bar calculated in the fourth step, and a seventh step of setting the roll gap in the subsequent stand based on the outer diameter of the location in the lengthwise direction of the mandrel bar calculated in the sixth step.

2. An elongation rolling control method as set forth in claim 1 characterized in that the ultrasonic wall thickness gauge is a laser-ultrasonic wall thickness gauge.

* * * * *